US007480390B2

(12) United States Patent
Tabata et al.

(10) Patent No.: US 7,480,390 B2
(45) Date of Patent: Jan. 20, 2009

(54) LOUDSPEAKER EDGE

(75) Inventors: Shinya Tabata, Mie (JP); Hidekazu Tanaka, Singapore (SG)

(73) Assignee: Panasonic Corporation, Osaka (JP)

( * ) Notice: Subject to any disclaimer, the term of this patent is extended or adjusted under 35 U.S.C. 154(b) by 53 days.

(21) Appl. No.: 10/517,261

(22) PCT Filed: Jun. 26, 2002

(86) PCT No.: PCT/JP02/06431

§ 371 (c)(1),
(2), (4) Date: Dec. 7, 2004

(87) PCT Pub. No.: WO2004/004410

PCT Pub. Date: Jan. 8, 2004

(65) Prior Publication Data

US 2005/0226456 A1 Oct. 13, 2005

(51) Int. Cl.
*H04R 7/18* (2006.01)
*H04R 9/00* (2006.01)

(52) U.S. Cl. ..... 381/398; 181/172

(58) Field of Classification Search ..... 381/398, 381/423, 403, 404, 431, 386; 181/171, 172, 181/173, 174
See application file for complete search history.

(56) References Cited

U.S. PATENT DOCUMENTS

| | | | | |
|---|---|---|---|---|
| 5,371,805 | A * | 12/1994 | Saiki et al. | 381/398 |
| 6,171,534 | B1 * | 1/2001 | Leach et al. | 264/102 |
| 6,543,573 | B2 * | 4/2003 | Ishihara et al. | 181/167 |
| 6,543,574 | B1 * | 4/2003 | Mizone et al. | 181/171 |
| 6,611,604 | B1 * | 8/2003 | Irby et al. | 381/398 |
| 6,680,430 | B2 * | 1/2004 | Tabata et al. | 84/171 |
| 6,700,987 | B2 * | 3/2004 | Kuze et al. | 381/398 |
| 6,889,796 | B2 * | 5/2005 | Pocock et al. | 181/172 |
| 2001/0011615 | A1 * | 8/2001 | Iwasa et al. | 181/172 |
| 2003/0002695 | A1 * | 1/2003 | Takahashi et al. | 381/111 |
| 2003/0068064 | A1 * | 4/2003 | Czerwinski | 381/398 |
| 2004/0086143 | A1 * | 5/2004 | Espiritu | 381/398 |

FOREIGN PATENT DOCUMENTS

| | | | |
|---|---|---|---|
| JP | 51-13061 | | 4/1976 |
| JP | 53-124414 | | 10/1978 |
| JP | 58221597 | A * | 12/1983 |
| JP | 3-247099 | | 11/1991 |
| JP | 05122791 | A * | 5/1993 |
| JP | 5-236593 | | 9/1993 |
| JP | 5-316590 | | 11/1993 |
| JP | 06125594 | A * | 5/1994 |
| JP | 6-315194 | | 11/1994 |
| JP | 10126881 | A * | 5/1998 |
| WO | WO 200054555 | A1 * | 9/2000 |
| WO | WO 200235883 | A1 * | 5/2002 |

* cited by examiner

*Primary Examiner*—Curtis Kuntz
*Assistant Examiner*—Joseph Saunders, Jr.
(74) *Attorney, Agent, or Firm*—Wenderoth, Lind & Ponack, L.L.P.

(57) ABSTRACT

The present invention provides a loudspeaker including an edge formed in such manner that a thickness of a sectional shape in a radial direction increases from an inner peripheral portion toward an outer peripheral portion. Due to this structure, a mechanical impedance of the edge against a diaphragm is decreased and bad influences on a vibration mode of the diaphragm are suppressed, and also, vibration energy is absorbed by a thick portion of the outer peripheral portion, thereby suppressing standing waves of the diaphragm.

25 Claims, 8 Drawing Sheets

LOUDSPEAKER EDGE

TECHNICAL FIELD

The present invention relates to a loudspeaker mainly used in an acoustic apparatus.

BACKGROUND ART

Firstly, a conventional loudspeaker is described with reference to FIG. 19 showing a top view of a conventional long shaped loudspeaker (especially, a loudspeaker with a large length to width ratio in shape, which is hereafter generally recited as a "slim loudspeaker"), and FIG. 20 showing a two-directional sectional view in lengthwise and widthwise directions of the slim loudspeaker.

Magnetic circuit 6 shown in FIG. 20 comprises lower plate 6*a*, ring-shaped magnet 6*b*, and upper plate 6*c*. Frame 5 is bonded to the magnetic circuit 6. An outer peripheral portion of diaphragm 2 is bonded to the frame 5 via edge 1, and an inner peripheral portion thereof is bonded to voice coil 3 inserted in magnetic gap 6*d* of the magnetic circuit 6.

An outer peripheral portion of damper 4 is bonded to the frame 5, and an inner peripheral portion is bonded to the voice coil 3 to support the voice coil 3.

As the edge 1 used in such a loudspeaker, there are a "fixed edge" which is formed of an extended portion of a diaphragm material, and a "Free edge" using other material. Structurally, the former is formed in one-piece structure using a same paper material as the diaphragm by extending a portion thereof, and a plurality of corrugations that are similar to the outer peripheral portion of the diaphragm are formed to provide compliance. The latter is generally made of urethane foam, foamed rubber or like materials, which is formed into a sheet and thermally formed into a predetermined shape such as a corrugation edge and a roll edge.

The edge 1 is required to have two functions, which are:

(1) to support the diaphragm 2 so as not to induce troubles in terms of vibration, and also to reproduce sound free from non-linear distortion; and (2) to suppress an anti-resonance and a partial resonance of the diaphragm 2, including the edge 1, by absorbing vibration energy of the diaphragm 2 so that reproduced sound quality is not badly affected by a generation of dip on "output sound pressure level vs. frequency" characteristics of the loudspeaker.

To address this above requirement, the edge 1 is required to have appropriate stiffness and to be excellent in terms of mechanical internal losses and linearity relative to displacement of the diaphragm 2 due to a driving force. In order to satisfy these requirements, a material of the edge 1, a sectional shape along a radial direction thereof, and a weight and weight distribution thereof have been studied.

Regarding a shape and structure of the edge 1, which supports the outer peripheral portion of diaphragm 2, corresponding to various shapes of loudspeakers such as the slim loudspeaker mentioned above, there are problems to be solved. That is, results of studies are not satisfactory with regard to "sectional shape, weight and weight distribution, and stiffness" in relation to "mechanical internal losses and linearity of displacement relative to driving force."

In order to address the above problems of a conventional edge, the present invention provides a loudspeaker having an edge improved in terms of sectional shape, weight and weight distribution and stiffness distribution, taking into account a relationship of displacement linearity of the edge itself and a mechanical impedance of a diaphragm. The loudspeaker of the present invention is excellent in terms of acoustic characteristics such as frequency characteristics, transient characteristics, and distortion characteristics.

SUMMARY OF THE INVENTION

The loudspeaker of the present invention comprises a magnetic circuit, a frame connected to the magnetic circuit, and a diaphragm which is connected to a voice coil via an inner peripheral portion of the diaphragm, and is connected via an outer peripheral portion of the diaphragm to the frame via an edge. The voice coil is inserted into a magnetic gap of the magnetic circuit, and a thickness of a sectional shape of an inner peripheral portion of the edge is thinner than a thickness of a sectional shape of an outer peripheral portion of the edge. The edge is made of an elastic resin or a foamed resin.

DETAILED DESCRIPTION OF THE PREFERRED EMBODIMENTS

Example 1

A first example of the present invention will be described in the following with reference to FIG. 1 and FIG. 2.

Figure 1:
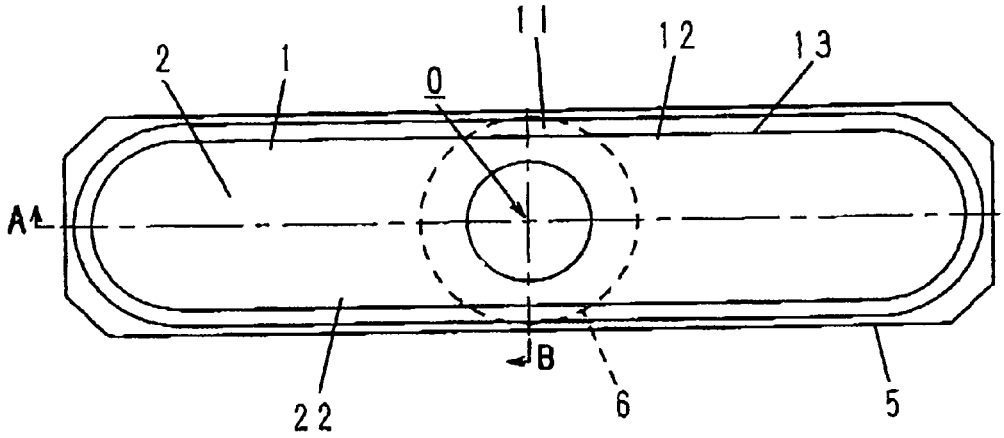
FIG. 1 is a top view of a loudspeaker in one embodiment of the present invention.

FIG. 1 is a top view of a slim loudspeaker according to the first example of the present invention. FIG. 2 shows cross sections of the loudspeaker in two directions of AO (lengthwise direction) and BO (widthwise direction) in FIG. 1. In FIG. 2, magnetic circuit 6 comprises lower plate 6*a*, ring magnet 6*b*, and upper plate 6*c*. An outer peripheral portion of diaphragm 2 is bonded via edge 1 to frame 5 which is bonded to the magnetic circuit 6, and an inner peripheral portion of the diaphragm 2 is bonded to voice coil 3 inserted into magnetic gap 6*d* of the magnetic circuit 6.

An outer peripheral portion of damper 4 is bonded to the frame 5, and an inner peripheral portion thereof is bonded to the voice coil 3 to support the voice coil 3.

When a signal current flows in the voice coil 3, a driving force is generated to vibrate the diaphragm 2, thereby radiating acoustic waves corresponding to a wave form of the signal current. The damper 4 and the edge 1 support the diaphragm 2 together at upper and lower positions, and the damper 4 and the edge 1 function so that the diaphragm 2 and the voice coil 3 are able to vibrate along an axial direction of the loudspeaker in a stable state.

Figure 2:
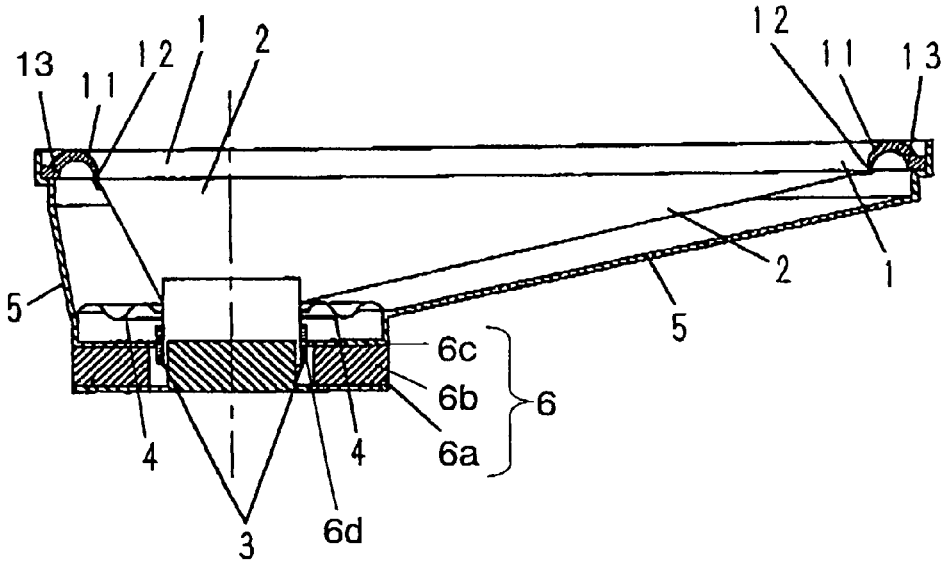
FIG. 2 is a two-directional sectional view of the loudspeaker of FIG. 1.

The edge 1 of the present embodiment is made of a foamed resin mainly based on a polyurethane resin that is an elastic resin, and a sectional shape in a radial direction is, as shown in FIG. 2, a roll edge extended upward in an arc shape. Also, the edge 1 is formed so that a thickness of an inner peripheral portion 12 side bonded to the diaphragm 2 of flexible portion 11 is thinner and a thickness of an outer peripheral portion 13 side is thicker. Since a sectional shape is formed in this way, a thinner portion that is connected to the diaphragm 2 and mainly vibrates is light-weight, flexible, and low in mechanical impedance; thus, bad influences on a vibration mode of the diaphragm become less. At the same time, since the outer peripheral portion 13 side is thicker, an absorption of vibration energy transferred from the diaphragm 2 is increased, thereby preventing generation of standing waves in the diaphragm 2. Preventing generation of standing waves increases an efficiency of medium and high frequency range sounds radiated from the loudspeaker and further greatly improves frequency characteristics, non-linear distortion characteristics, and transient characteristics. Although it is not illustrated in the figures, as an edge modified in shape from the present example, it is also possible to use an edge with a structure such that ratios of change in thickness from an inner peripheral portion to an outer peripheral portion are changed according to changes in stiffness in lengthwise and widthwise directions of the diaphragm. By using this structure, it is possible to further improve the frequency characteristics, non-linear distortion characteristics, and transient characteristics.

Figure 3:
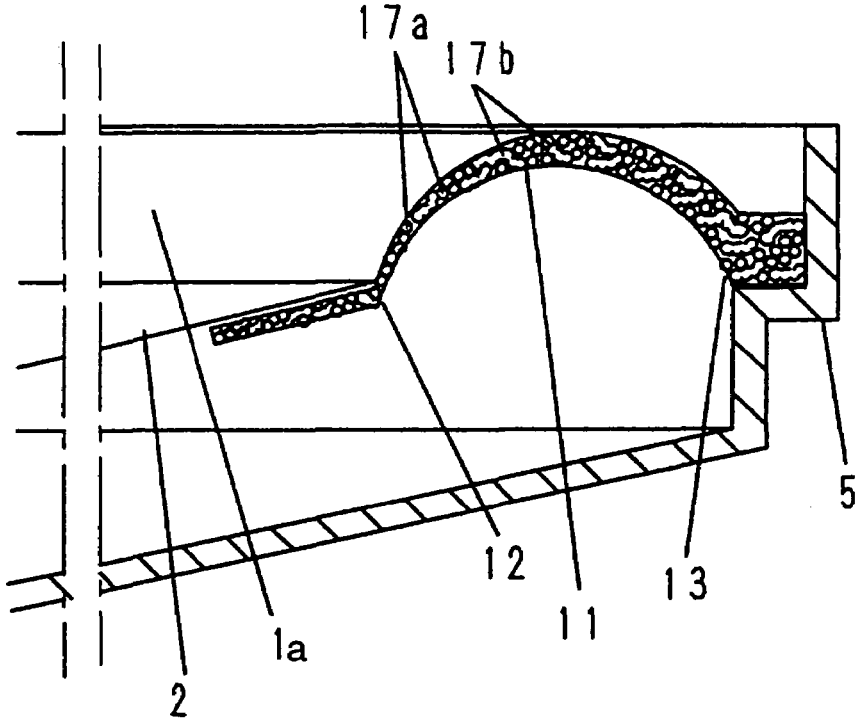
FIG. 3 is an enlarged sectional view of an edge which is an essential portion of one modification of the present invention.

FIG. 3 shows a modification of the present example, showing an enlarged sectional shape of an edge that is an essential portion. A structural difference between the modification and the Example 1 is that, edge 1*a* of the modification has a foamed condition where both of independent foam 17*a* and continuous foam 17*b* coexist. Due to this structure, the edge 1*a* has a gas-tight characteristic necessary as an edge, and movement of gas in the continuous foam 17*b* increases mechanical internal losses, and contributes to further improve frequency characteristics.

Figure 4:
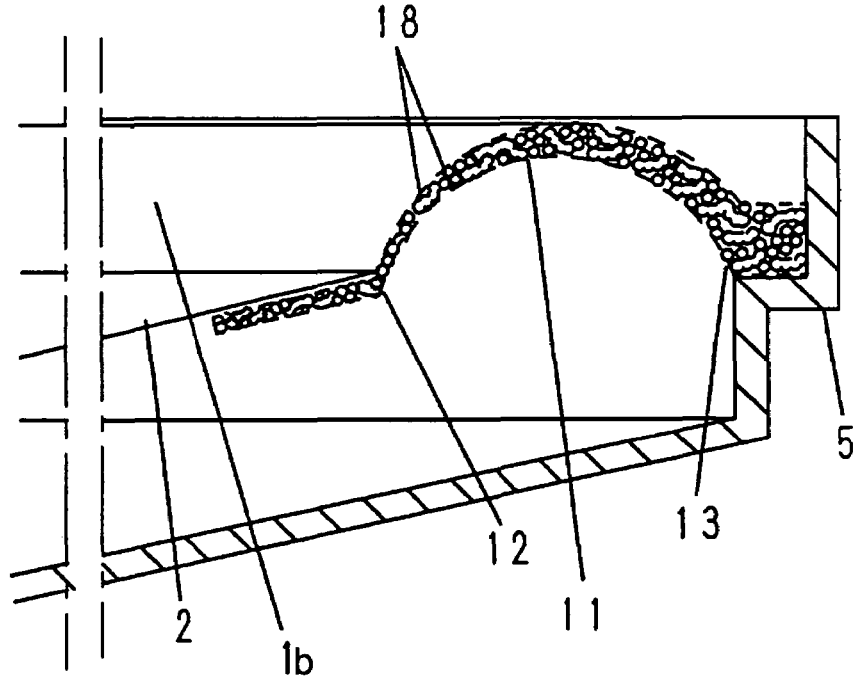
FIG. 4 is an enlarged view of an edge of another modification of the present invention.

FIG. 4 shows another modification of the present example, showing an enlarged sectional shape of an edge that is an essential portion. In this modification, edge 1*b* has skin layers 18 on both surfaces. Each skin layer 18 of each surface is of one-piece construction with an internal foamed layer without having a clear interface. Thus, the edge 1*b* exhibits features of being soft and light in weight.

Figure 5:
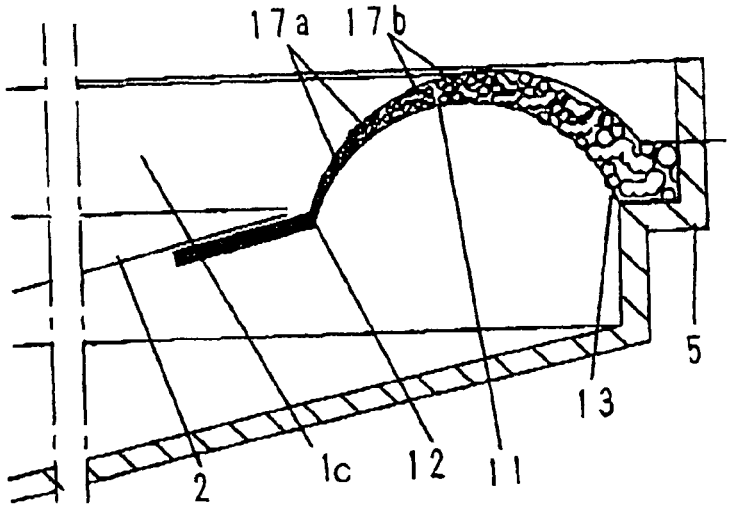
FIG. 5 is an enlarged view of an edge of still another modification of the present invention.

FIG. 5 is still another modification of the present example, showing an enlarged sectional shape of an edge that is an essential portion. In this modification, an expansion ratio is changed so that a density of inner peripheral portion 12, or a bend portion of edge 1*c*, is higher than a density of an outer peripheral portion 13. In this way, decrease in strength of a thinned inner peripheral portion is suppressed. As a method to change the expansion ratio, two or more kinds of resins, varied in an amount of foaming agent blended into the resins for molding, are molded by multi-color injection molding, or by press molding, wherein a plurality of resins (generally sheet-formed) varied in an amount of foaming agent are disposed in a molding die and formed under heat and pressure. Accordingly, during the press molding, at a portion corresponding to a vicinity of inner peripheral portion 12, or a bend portion, a resin less in an amount of foaming agent is disposed.

Although an illustration is omitted, a modification of a roll edge where the flexible portion 11 is bent downward in an arc shape may be used.

For production of the edge 1*a* which includes both of the independent foam 17*a* and continuous foam 17*b* described above, a foaming thermosetting composition obtained by mechanically mixing gas with a thermosetting composition mainly based on a polyurethane prepolymer and a latent hardener is molded under heat. As the latent hardener, so-called amine adduct, obtained by inactivating solid polyamine, was used in the present example. This is also used in each of the following Examples. However, the latent hardener is not limited to this substance provided that it is dissociated under heat and forms a urethane resin.

Also, the above urethane resin is preferable as a diaphragm support member, taking into account acoustic performance for loudspeakers; however, as a material for the edge, it is also possible to use a thermosetting resin and thermoplastic resin composition made of other synthetic resin, thermoplastic elastomer, rubber or foamed resins made of the above resins.

In the present example, a variation of thickness of the edge in the lengthwise direction and that of the edge in the widthwise direction can be varied to improve characteristics. In other words, a thickness ratio of the edge in the lengthwise direction between the inner peripheral portion 12 and the outer peripheral portion 13 is made large to enhance rigidity of the edge in the lengthwise direction, while a ratio of the edge in the widthwise direction is made small. By designing rigidity of these two kinds of edges, i.e., a lengthwise direction edge and a widthwise direction edge, in such a way, a total edge unit becomes improved to have excellent rigidity balance to improve frequency characteristics, non-linear distortion characteristics, and transient characteristics.

Example 2

Figure 6:
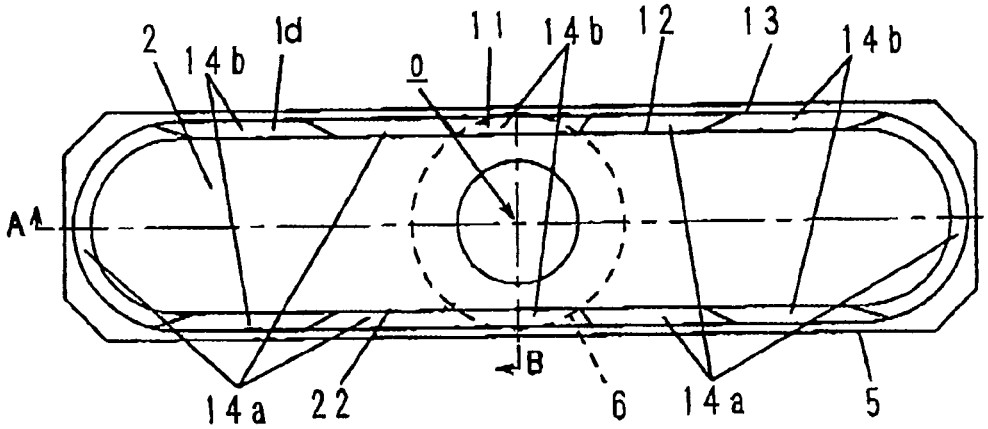
FIG. 6 is a top view of another loudspeaker of the present invention.
Figure 7:
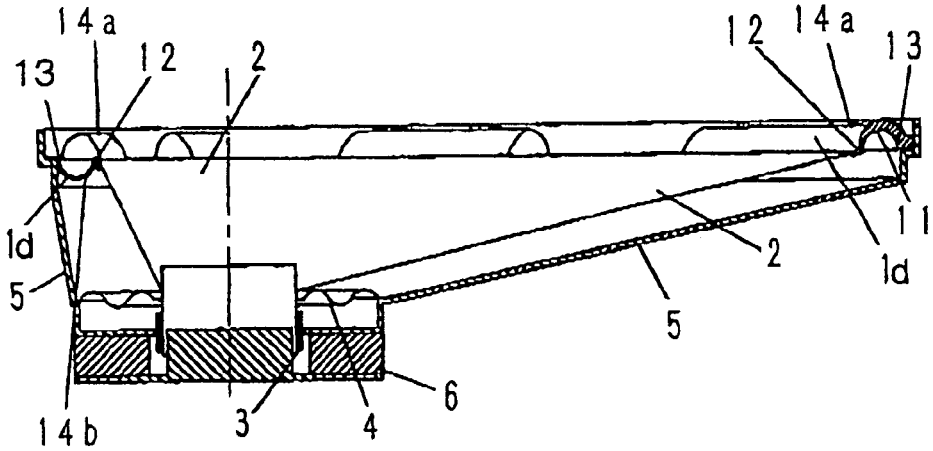
FIG. 7 is a two-directional sectional view of the loudspeaker of FIG. 6.

FIG. 6 is a top view of a slim loudspeaker in accordance with another example of the present invention. FIG. 7 is a sectional view of this loudspeaker in two directions of AO and BO in FIG. 6. In the description of the present example, same component parts as those in Example 1 are given same reference numerals, and a description thereof is omitted.

Edge 1*d* of the present example is made of foamed resin mainly based on polyurethane resin the same as in Example 1, and its flexible portion is divided into a plurality of sections in a circumferential direction with convex portion 14*a* and concave portion 14*b* alternately arranged. Further, a boundary between adjacent sections crosses the edge 1*d* at an angle different from a peripheral direction, and thereby, a shape smoothly changes from convex to concave without abruptly changing in shape. In general, a displacement of an edge in a direction of a convexity and in a direction of a concavity are reverse in linearity with respect to a driving force, and this causes a generation of non-linear distortion. However, in the present example, since the convex portion 14*a* and the concave portion 14*b* are alternately arranged, generation of non-linear distortion in reproduced sound reduces because of mutual neutralization of non-linearity. Further, unnecessary resonance of a diaphragm is suppressed by the convexities and concavities of the edge.

Figure 8:
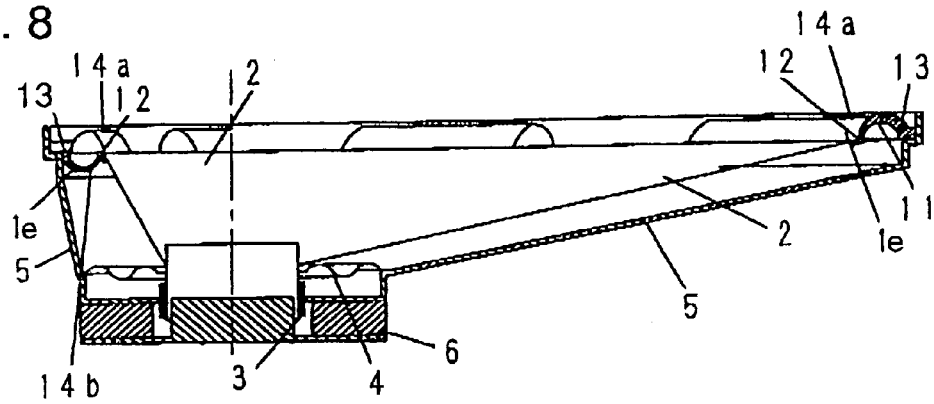
FIG. 8 is a two-directional sectional view of yet another loudspeaker of the present invention.

FIG. 8 shows a modification of the present example, showing a half-sectional view in directions of AO and BO in FIG. 6, and also shows a sectional shape of edge 1*e*. The edge 1*e* is made of foamed resin mainly based on polyurethane resin the same as in the Example 1, and a flexible portion of the edge 1*e* is divided into a plurality of sections with convex portion 14*a* and concave portion 14*b* alternately distributed in a circumferential direction as in the present example, and also, a sectional shape in a radial direction is formed such that a thickness at an inner peripheral portion 12 side is thinner, and a thickness at an outer peripheral portion 13 side thicker, as in Example 1.

Non-linear distortion of the loudspeaker of this modification is reduced, and at the same time, a portion which is connected to the diaphragm 2 and mainly vibrates is lightweight and flexible, and is low in terms of mechanical impedance, thereby decreasing a bad influence on a vibration mode of the diaphragm, as in Example 1. At the same time, since the outer peripheral portion 13 side is thicker, absorption of vibration energy transferred from the diaphragm 2 is increased, and thus a generation of standing waves in the diaphragm 2 can be prevented. As a result, this structure increases an efficiency of medium and high frequency range sounds radiated from the loudspeaker, and further, greatly contributes to improve frequency characteristics, non-linear distortion characteristics, and transient characteristics.

Example 3

Figure 9:
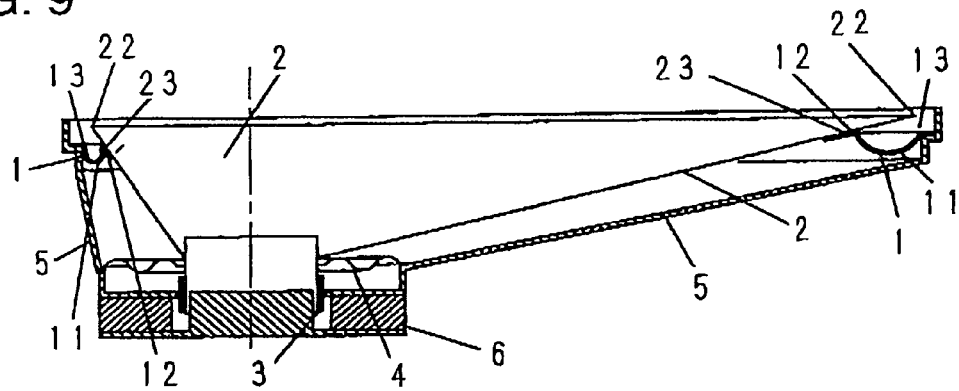
FIG. 9 is a two-directional sectional view of still another loudspeaker of the present invention.

FIG. 9 is a sectional view in two directions of AO and BO of another loudspeaker having the shape of FIG. 6. In the present example, a diameter of an inner peripheral portion 12 of edge 1 made of foamed resin mainly based on a polyurethane resin, as in Example 1, is formed smaller than a diameter of an outer peripheral portion 22 of diaphragm 2. In the loudspeaker of the present example, the diaphragm 2 is supported by the edge 1 with inner portion 23 formed inwardly from the outer peripheral portion 22 thereof. According to a configuration of the present example, in a case where a same maximum dimension of a frame is employed, it is possible to improve a low frequency range sound reproduction and to increase efficiency by maximizing an effective area of the diaphragm.

Figure 10:
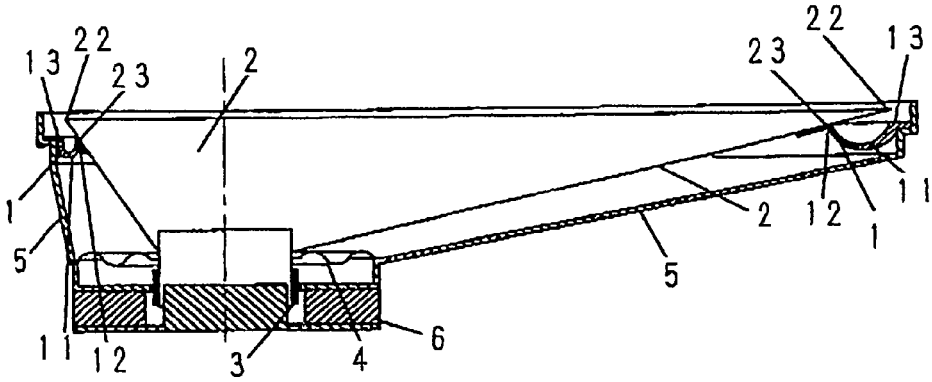
FIG. 10 is a two-directional sectional view of a modification of still another loudspeaker of the present invention.

FIG. 10 shows a modification of the present example, showing a sectional view in the same direction as in FIG. 9. As in Example 1, a sectional shape in a radial direction of edge 1 made of foamed resin mainly based on polyurethane resin is formed such that a diameter of inner peripheral portion 12 is smaller than a diameter of the outer peripheral portion 22 of diaphragm 2, and the diaphragm 2 is supported via an inner portion inward from the outer peripheral portion 22. Further, as shown in FIG. 10, an inner peripheral portion side bonded to the diaphragm 2 is formed thinner, and an outer peripheral portion side is formed thicker. The loudspeaker of this modification can increase efficiency, as in Example 1, increases efficiency of medium and high frequency range sounds, and further, greatly contributes to improve frequency characteristics, non-linear distortion characteristics, and transient characteristics.

Example 4

Figure 11:
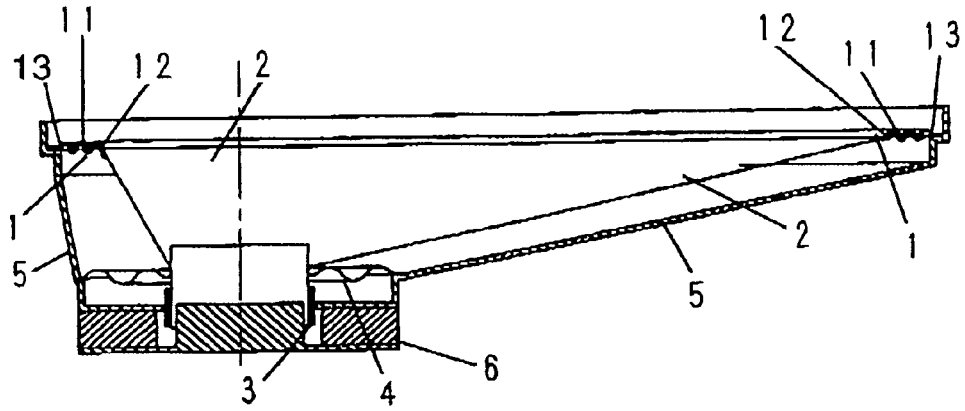
FIG. 11 is a two-directional sectional view of yet another loudspeaker of the present invention.

FIG. 11 shows a sectional shape in two directions, lengthwise and widthwise directions, of edge 1 bonded to diaphragm 2 of a loudspeaker in the present example. In the present example, as in Example 1, flexible portion 11 of an edge made of foamed resin mainly based on polyurethane resin is formed to have corrugated sections with narrow concave corrugations and convex corrugations alternately arranged. A non-linearity of concave corrugations compensates a non-linearity of convex corrugations, thereby decreasing a level of non-linear distortion in a case of small amplitude.

Figure 12:
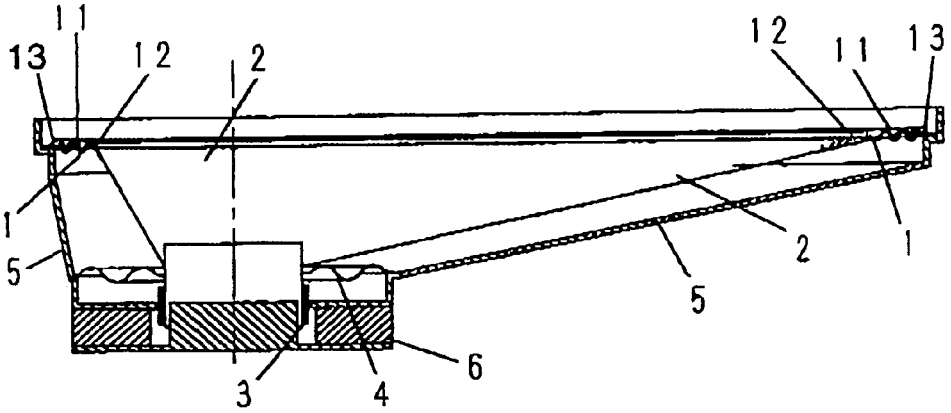
FIG. 12 is a two-directional sectional view of a modification of yet another loudspeaker of the present invention.

FIG. 12 shows a modification of the present example, showing a sectional shape viewed in two directions of edge 1. As in Example 1, a sectional shape in a radial direction of edge 1 made of foamed resin mainly based on polyurethane resin is formed to have a corrugated shape. Further, as shown in FIG. 12, the sectional shape of the edge 1 is formed such that a thickness of an inner peripheral portion side bonded to the diaphragm 2 is thinner, and a thickness of an outer peripheral portion side is thicker. In a case of small amplitude, this modification decreases a level of non-linear distortion, and as in Example 1, it also increases efficiency at medium and high frequency range sounds, and further, greatly contributes to improve frequency characteristics, non-linear distortion characteristics, and transient characteristics.

Example 5

Figure 13:
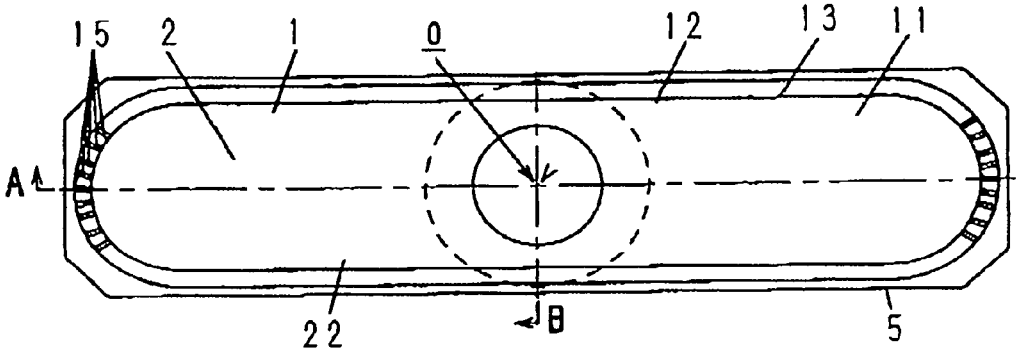
FIG. 13 is a top view of another loudspeaker of the present invention.
Figure 14:
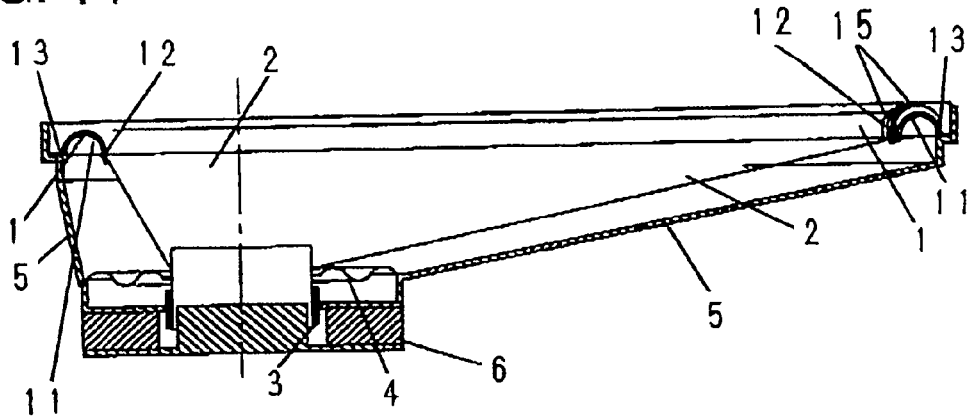
FIG. 14 is a two-directional sectional view of the another loudspeaker of FIG. 13.

FIG. 13 is a top view of a loudspeaker according to the present example. FIG. 14 shows a sectional shape in two directions of AO and BO in FIG. 13. In the present example, as in Example 1, in a lengthwise direction of flexible portion 11 of an edge made of foamed resin mainly based on polyurethane resin, a plurality of rib-shaped convex portions (ribs) 15 are provided in a radial direction by increasing resin thickness so as to change compliance of the edge. The convex portions 15 are intended to prevent a resonance and deformation of diaphragm 2 by balancing with lengthwise stiffness of the diaphragm and to improve frequency characteristics.

Also in the present example, although an illustration is omitted, it is possible to make a plurality of modifications. For example, possible modifications include a structure in which edge material is formed thinner at an inner peripheral portion side and thicker at an outer peripheral portion side, a structure in which a height of the ribs 15 or an effective thickness of edge portion including the height of rib 15 is thinner at the inner peripheral portion side and thicker at the outer peripheral portion side, and other various modifications.

Example 6

Figure 15:
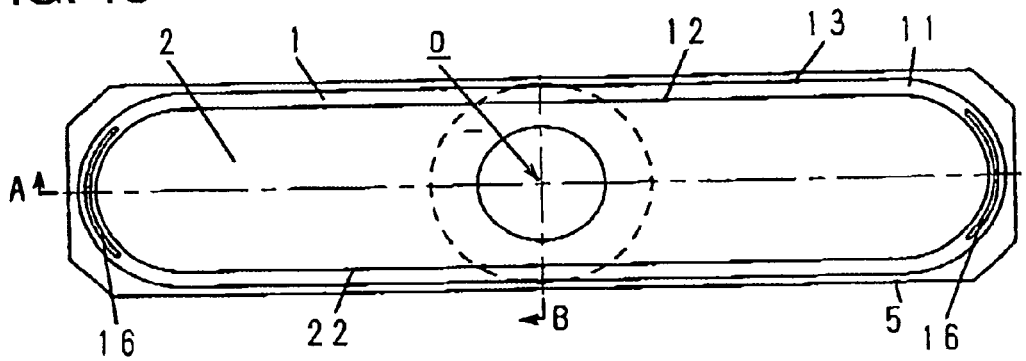
FIG. 15 is a top view of another loudspeaker of the present invention.
Figure 16:
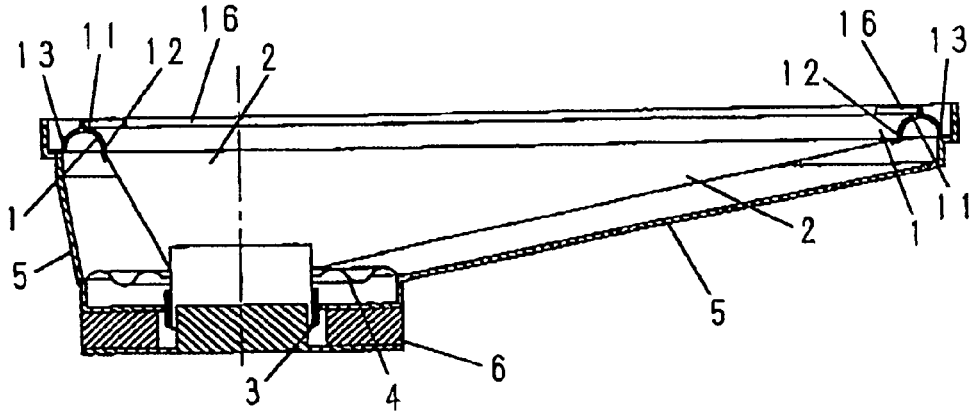
FIG. 16 is a two-directional sectional view of the another loudspeaker of FIG. 15.

FIG. 15 is a top view of a loudspeaker of the present example. FIG. 16 shows a sectional view in two directions of AO and BO of the loudspeaker in FIG. 15.

In a loudspeaker of the present example, in a lengthwise direction of flexible portion 11 of an edge made of foamed resin mainly based on polyurethane resin, as in Example 1, rib-shaped convex portions (rib) 16 increased in thickness of resin along a peripheral direction are partially provided in order to change compliance of the edge. This structure is intended to prevent resonance and deformation of diaphragm 2 by balancing with lengthwise stiffness of the diaphragm and to improve frequency characteristics.

Also in the present example, although an illustration is omitted, it is possible to make a plurality of modifications. For example, a possible example of a modification is such that a thickness of edge material or an effective thickness of an edge portion including a height of the rib is formed thinner at an inner peripheral portion side and thicker at an outer peripheral portion side.

Example 7

Figure 17:
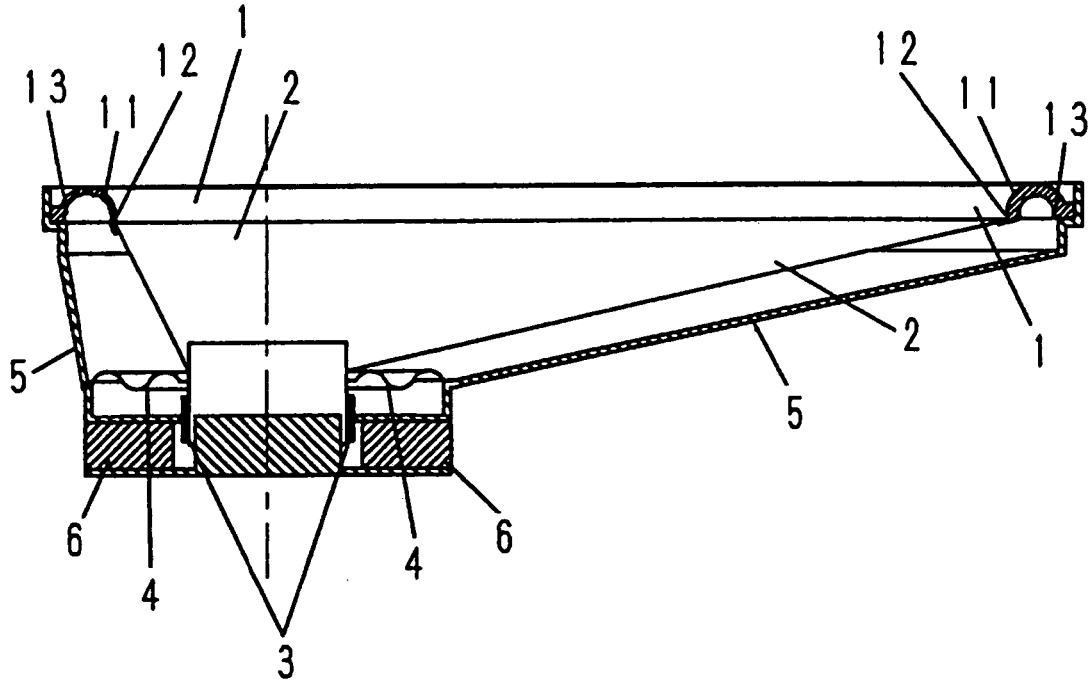
FIG. 17 is a two-directional view of another loudspeaker of the present invention.

FIG. 17 shows a sectional view in two directions, lengthwise and widthwise directions, of a loudspeaker in the present example. Flexible portion 11 of an edge made of foamed resin mainly based on polyurethane resin, as in Example 1, is partially changed in edge compliance in accordance with a change in stiffness of diaphragm 2. To achieve this purpose, a thickness of the flexible portion 11 of the edge is increased in a lengthwise direction and a thickness is decreased in a widthwise direction, and the flexible portion 11 is formed so as to smoothly change in terms of thickness. This structure is intended to prevent resonance and deformation of the diaphragm 2 by balancing with lengthwise stiffness of the diaphragm and to improve frequency characteristics.

Also in the present example, although an illustration is omitted, it is possible to make a plurality of modifications. For example, a possible example of a modification is such that structure of the present embodiment is combined with a structure wherein a substantial thickness of the edge portion is formed thinner at an inner peripheral portion side and thicker at an outer peripheral side.

Example 8

Figure 18:
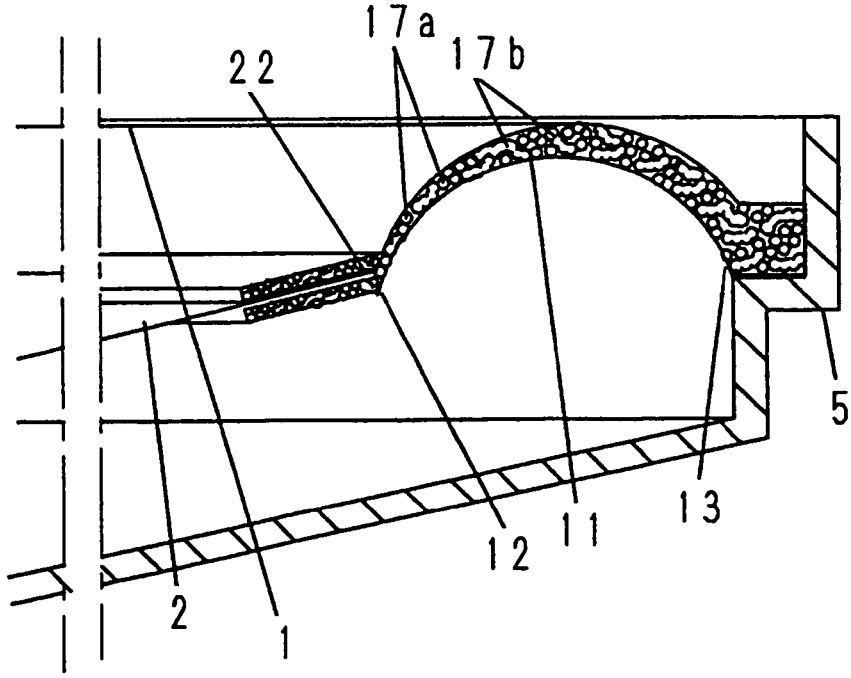
FIG. 18 is an enlarged sectional view of an edge which is an essential portion of another loudspeaker of the present invention.
Figure 19:
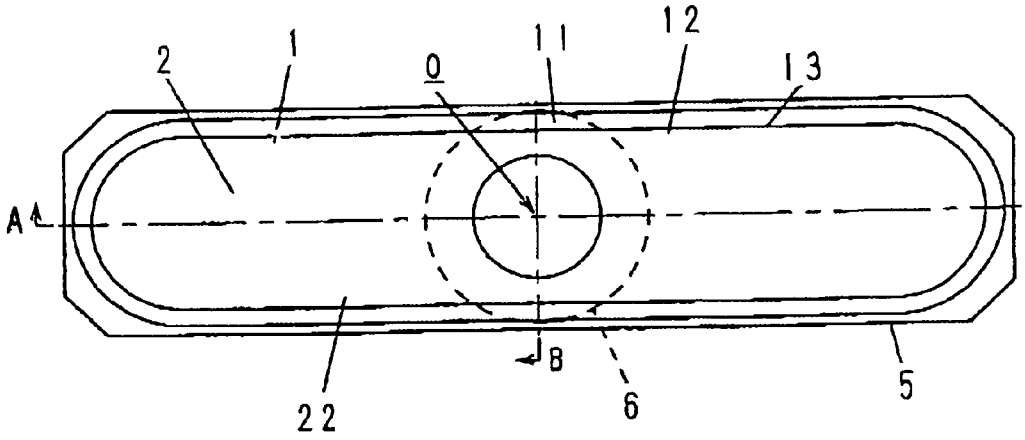
FIG. 19 Prior Art
FIG. 19 is a top view of a conventional slim loudspeaker.
Figure 20:
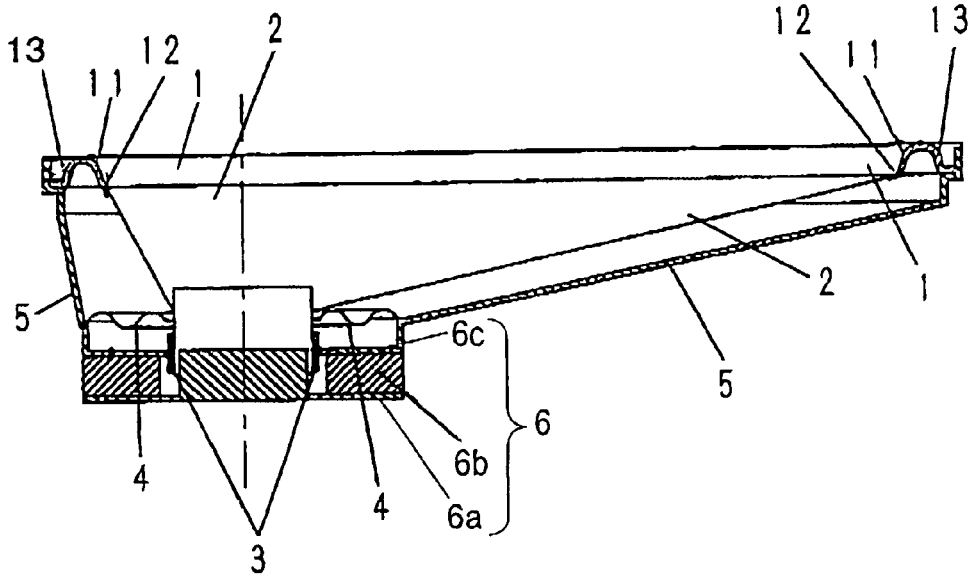
FIG. 20 Prior Art
FIG. 20 is a two-directional sectional view of the conventional slim loudspeaker.

FIG. 18 is an enlarged sectional view showing a combined structure of diaphragm 2 and edge 1 which are essential portions of a loudspeaker in the present example. In the present example, when a foaming thermosetting composition, a raw material of the edge 1, is placed in a molding die and is molded under heat, the diaphragm 2 is insert-molded to combine the edge 1 and the diaphragm 2.

Due to this insert molding, when assembling the loudspeaker, an assembling cost can be reduced because a step of bonding the edge 1 and the diaphragm 2 can be omitted. Further, both components are uniformly connected with each other under sufficient adhesive strength. Moreover, this connection does not increase a weight due to an adhesive agent, and thus improves performance of the loudspeaker.

Above described are representative examples and modifications of the present invention, but the present invention is not limited to the above structures. For example, in the above examples, an edge mainly using foamed urethane resin has been described. However, material of the edge is not limited to such material, and it is also possible to use thermoplastic elastomers, rubbers, and the like. Thus, it is possible to use an equivalent material in terms of quality or to change a molding method including die heating methods. Also, it is possible to perform proper change so long as requirements for configurations mentioned in the present invention are satisfied with respect to structures and shapes, and advantages described in the following can be obtained by achieving purposes of the present invention.

INDUSTRIAL APPLICABILITY

The speaker of the present invention, that is, a loudspeaker employing a diaphragm support mechanism, or an edge, has following advantages. Namely, the edge having a structure where an inner peripheral portion side is thinner and an outer peripheral portion side is thicker, has low mechanical impedance against the diaphragm and bad influences on a vibration mode of the diaphragm are decreased. At the same time, vibration energy is absorbed by a thick portion of the outer peripheral portion side, and thus standing waves of the diaphragm are suppressed, and efficiency of medium and high frequency range sounds radiated from the loudspeaker is increased, and further, this structure greatly contributes to improve frequency characteristics, non-linear distortion characteristics, and transient characteristics.

REFERENCE NUMERALS

1, 1*a*, 1*b*, 1*c*, 1*d*, 1*e* Edge
2 Diaphragm
3 Voice coil
4 Damper
5 Frame
6 Magnetic circuit
11 Flexible portion
12 Inner periphery portion
13 Outer periphery portion
14*a* Convex portion
14*b* Concave portion
15, 16 Convex portion (rib)
17*a* Independent foam
17*b* Continuous foam
18 Skin layer
22 Outer periphery
23 Inside portion

The invention claimed is:

1. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, the foamed layer being made of a foamed resin that includes both an independent foam and a continuous foam, wherein a thickness of a sectional shape of said inner peripheral portion of said edge member is thinner than a thickness of a sectional shape of said outer peripheral portion of said edge member, and wherein said radially innermost part of said arc portion has a higher density than said radially outermost part of said arc portion.

2. The loudspeaker according to claim 1, wherein said edge member includes skin layers on said foamed layer.

3. The loudspeaker according to claim 2, wherein said edge member includes convexities and concavities alternately arranged in a peripheral direction of said edge member.

4. The loudspeaker according to claim 2, wherein the loudspeaker has a length and a width, with the length being greater than the width, and a variation in thickness of said edge member in a lengthwise direction of the loudspeaker is greater than a variation in thickness of said edge member in a widthwise direction of the loudspeaker.

5. The loudspeaker according to claim 4, wherein a dimension of said inner peripheral portion of said edge member is smaller than a corresponding dimension of said outer peripheral portion said diaphragm.

6. The loudspeaker according to claim 4, wherein said edge member is corrugated in a direction from said inner peripheral portion of said edge member to said outer peripheral portion of said edge member.

7. The loudspeaker according to claim 4, wherein said edge member includes ribs in a direction from said inner peripheral portion of said edge member to said outer peripheral portion of said edge member.

8. The loudspeaker according to claim 4, wherein said edge member includes ribs in a peripheral direction of said edge member.

9. The loudspeaker according to claim 4, wherein a thickness of said edge member in a lengthwise direction of the loudspeaker is greater than a thickness of said edge member in a widthwise direction of the loudspeaker.

10. The loudspeaker according to claim 2, wherein an expansion ratio of said foamed resin differs between said inner peripheral portion of said edge member and said outer peripheral portion of said edge member.

11. The loudspeaker according to claim 2, wherein a dimension of said inner peripheral portion of said edge member is smaller than a corresponding dimension of said outer peripheral portion of said diaphragm.

12. The loudspeaker according to claim 2, wherein said edge member is corrugated in a direction from said inner peripheral portion of said edge member to said outer peripheral portion of said edge member.

13. The loudspeaker according to claim 2, wherein said edge member includes ribs in a direction from said inner peripheral portion of said edge member to said outer peripheral portion of said edge member.

14. The loudspeaker according to claim 2, wherein said edge member includes ribs in a peripheral direction of said edge member.

15. The loudspeaker according to claim 2, wherein the loudspeaker has a length and a width, with the length being greater than the width, and a thickness of said edge member in a lengthwise direction of the loudspeaker is greater than a thickness of said edge member in a widthwise direction of the loudspeaker.

16. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, the foamed layer being made of a foamed resin that includes both an independent foam and a continuous foam, wherein the loudspeaker has a length and a width, with the length being greater than the width, wherein a thickness of said edge member in a lengthwise direction of the loudspeaker is greater than a thickness of said edge member in a widthwise direction of the loudspeaker, and wherein said radially innermost part of said arc portion has a higher density than said radially outermost part of said arc portion.

17. The loudspeaker according to claim 16, wherein said edge member includes skin layers on said foamed layer.

18. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, said foamed layer being made of a foamed resin that includes both an independent foam and a continuous foam, and includes convexities and concavities alternately arranged in a peripheral direction of said edge member, and wherein said radially innermost part of said arc portion has a higher density than said radially outermost part of said arc portion.

19. The loudspeaker according to claim 18, wherein said edge member includes skin layers on said foamed layer.

20. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, the foamed layer being made of a foamed resin that includes both an independent foam and a continuous foam, wherein a dimension of said inner peripheral portion of said edge member is smaller than a corresponding dimension of said outer peripheral portion of said diaphragm, and wherein said radially innermost part of said arc portion has a higher density than said radially outermost part of said arc portion.

21. The loudspeaker according to claim 18, wherein said edge member includes skin layers on said foamed layer.

22. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, the foamed layer being made of a foamed resin that includes both an independent foam and a continuous foam, wherein said edge member is corrugated in a direction from said inner peripheral portion of said edge to said outer peripheral portion of said edge member, and wherein said radially innermost part of said arc portion has a higher density than said radially outermost part of said arc portion.

23. The loudspeaker according to claim 22, wherein said edge member includes skin layers on said foamed layer.

24. A loudspeaker comprising:

a magnetic circuit;

a frame connected to said magnetic circuit;

a voice coil that is positioned within a magnetic gap of said magnetic circuit;

a diaphragm;

an edge member that includes an inner peripheral portion, an arc portion and an outer peripheral portion, said inner peripheral portion of said edge member extending from an outer peripheral portion of said diaphragm to a radially innermost part of said arc portion and said outer peripheral portion of said edge member extending from said frame to a radially outermost part of said arc portion; and wherein said diaphragm includes said outer peripheral portion, which is bonded to said frame via said edge member, and an inner peripheral portion that is bonded to said voice coil, wherein in a sectional view said inner peripheral portion of said edge member and said outer peripheral portion of said edge member are straight, wherein said edge member is a separate member relative to said diaphragm and is bonded thereto, wherein said edge member comprises a foamed layer, the foamed layer being made of a foamed resin that includes both an independent foam and a continuous foam, wherein said edge member includes ribs that extend from said inner peripheral portion of said edge member to said outer peripheral portion of said edge member, and wherein said radially innermost part of said arc portion has a higher density than said radially outermost part of said arc portion.

25. The loudspeaker according to claim 24, wherein said edge member includes skin layers on said foamed layer.

* * * * *